US009296453B2

(12) United States Patent
Kuriyagawa et al.

(10) Patent No.: US 9,296,453 B2
(45) Date of Patent: Mar. 29, 2016

(54) CONTROL APPARATUS FOR BOAT

(71) Applicant: HONDA MOTOR CO., LTD., Minato-Ku, Tokyo (JP)

(72) Inventors: Koji Kuriyagawa, Wako (JP); Hiroshi Yamamoto, Wako (JP); Hajime Yoshimura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/305,145

(22) Filed: Jun. 16, 2014

(65) Prior Publication Data

US 2014/0370764 A1 Dec. 18, 2014

(30) Foreign Application Priority Data

Jun. 18, 2013 (JP) ..... 2013-127113

(51) Int. Cl.

| | |
|---|---|
| ***B63H 20/00*** | (2006.01) |
| ***B63H 3/10*** | (2006.01) |
| ***B63H 20/14*** | (2006.01) |
| *B63H 21/21* | (2006.01) |

(52) U.S. Cl.

CPC ..... *B63H 3/10* (2013.01); *B63H 21/265* (2013.01); *B63H 21/28* (2013.01); *B63H 2021/216* (2013.01)

(58) Field of Classification Search

CPC ..... B63H 3/10; B63H 20/00
USPC ..... 440/1, 6; 701/21
See application file for complete search history.

(56) References Cited

U.S. PATENT DOCUMENTS

| | | | | |
|---|---|---|---|---|
| 4,986,776 | A * | 1/1991 | Hensel | B63H 21/265 123/335 |
| 6,273,771 | B1 * | 8/2001 | Buckley | B63H 21/213 114/144 RE |
| 6,367,400 | B1 * | 4/2002 | Niggemann | G05D 1/0875 114/122 |
| 6,379,114 | B1 * | 4/2002 | Schott | B63H 3/10 416/1 |
| 7,214,164 | B2 * | 5/2007 | Shomura | B63H 20/20 340/456 |
| 7,473,076 | B2 * | 1/2009 | Rosenkranz | B63H 3/00 416/1 |
| 7,883,383 | B2 * | 2/2011 | Larsson | B63H 21/213 440/1 |
| 8,007,330 | B2 * | 8/2011 | Wong | B63H 20/12 440/61 S |
| 8,133,027 | B2 * | 3/2012 | Carvalho | B64C 11/30 416/1 |
| 8,393,924 | B1 * | 3/2013 | Daunais | B63H 3/06 440/50 |

(Continued)

FOREIGN PATENT DOCUMENTS

WO 2005/044659 A1 5/2005

*Primary Examiner* — Lars A Olson
*Assistant Examiner* — Jovon Hayes
(74) *Attorney, Agent, or Firm* — Carrier Blackman & Associates, P.C.; William D. Blackman; Joseph P. Carrier

(57) ABSTRACT

In an apparatus for controlling a boat equipped with an outboard motor mounted on its stern and having an internal combustion engine, a propeller to be driven by the engine and a propeller pitch changer adapted to variably change a pitch of the propeller, an opening of a throttle valve installed at an air intake system of the engine and its change amount are detected, and based on the change amount of the detected opening of the throttle valve, it is determined whether or not the pitch of the propeller is to be changed through the propeller pitch changer.

12 Claims, 6 Drawing Sheets

(56) References Cited

U.S. PATENT DOCUMENTS 8,583,300 B2 * 11/2013 Oehlgrien ..... B63B 39/061
114/275

2005/0263058 A1 * 12/2005 Suemori ..... B63H 21/22
114/144 R

2006/0052014 A1 * 3/2006 Kobayashi ..... B63H 20/00
440/53

2008/0014806 A1 * 1/2008 Ide ..... B63H 20/00
440/83

2011/0195816 A1 * 8/2011 Martin ..... B60W 10/06
477/115

2013/0115832 A1 * 5/2013 Suzuki ..... B63H 21/14
440/1

2014/0295717 A1 * 10/2014 Kuriyagawa ..... B63H 20/10
440/1

2014/0370764 A1 * 12/2014 Kuriyagawa ..... B63H 3/10
440/1

* cited by examiner

CONTROL APPARATUS FOR BOAT

BACKGROUND

1. Technical Field

An embodiment of this invention relates to a control apparatus for boat, more particularly to a control apparatus for a boat equipped with an outboard motor having a variable pitch propeller.

2. Background Art

A control apparatus for a boat or ship whose propeller pitch can be regulated according to a navigation mode such as a cruise mode or steering mode has been proposed, for example, by International Publication No. 2005/044659 (corresponding to Japanese Patent Publication 2007-509792). The technique disclosed in the reference is to enhance both navigation performance and economic efficiency of the boat by regulating the propeller pitch according to the navigation mode.

SUMMARY

With the technique disclosed in the reference, the propeller pitch can be regulated according to the navigation mode. However, since the propeller pitch is not regulated finely according to a navigation condition of the boat that changes from moment to moment, it is difficult to enhance both navigation performance (acceleration performance and maximum-speed performance) and economic efficiency (fuel efficiency performance) of the boat at high level.

Therefore, an object of an embodiment of this invention is to overcome the foregoing problem by providing a control apparatus for boat that enhances fuel efficiency, acceleration and maximum-speed performance by selecting an optimum propeller pitch according to the navigation condition of the boat.

In order to achieve the object, the embodiment of this invention provides in a first aspect an apparatus for controlling a boat equipped with an outboard motor mounted on its stern and having an internal combustion engine, a propeller to be driven by the engine and a propeller pitch changer adapted to variably change a pitch of the propeller, comprising: a throttle opening detector that detects an opening of a throttle valve installed at an air intake system of the engine; a throttle opening change amount calculator that calculates a change amount of the detected opening of the throttle valve; and a propeller pitch change determiner that determines whether or not the pitch of the propeller is to be changed through the propeller pitch changer based on the change amount of the detected opening of the throttle valve.

In order to achieve the object, the embodiment of this invention provides in a second aspect a method for controlling a boat equipped with an outboard motor mounted on its stern and having an internal combustion engine, a propeller to be driven by the engine and a propeller pitch changer adapted to variably change a pitch of the propeller, comprising the step of: detecting an opening of a throttle valve installed at an air intake system of the engine; calculating a change amount of the detected opening of the throttle valve; and determining whether or not the pitch of the propeller is to be changed through the propeller pitch changer based on the change amount of the detected opening of the throttle valve.

BRIEF DESCRIPTION OF THE DRAWINGS

The above and other objects and advantages of an embodiment of this invention will be more apparent from the following description and drawings in which.

and

Figure 5:
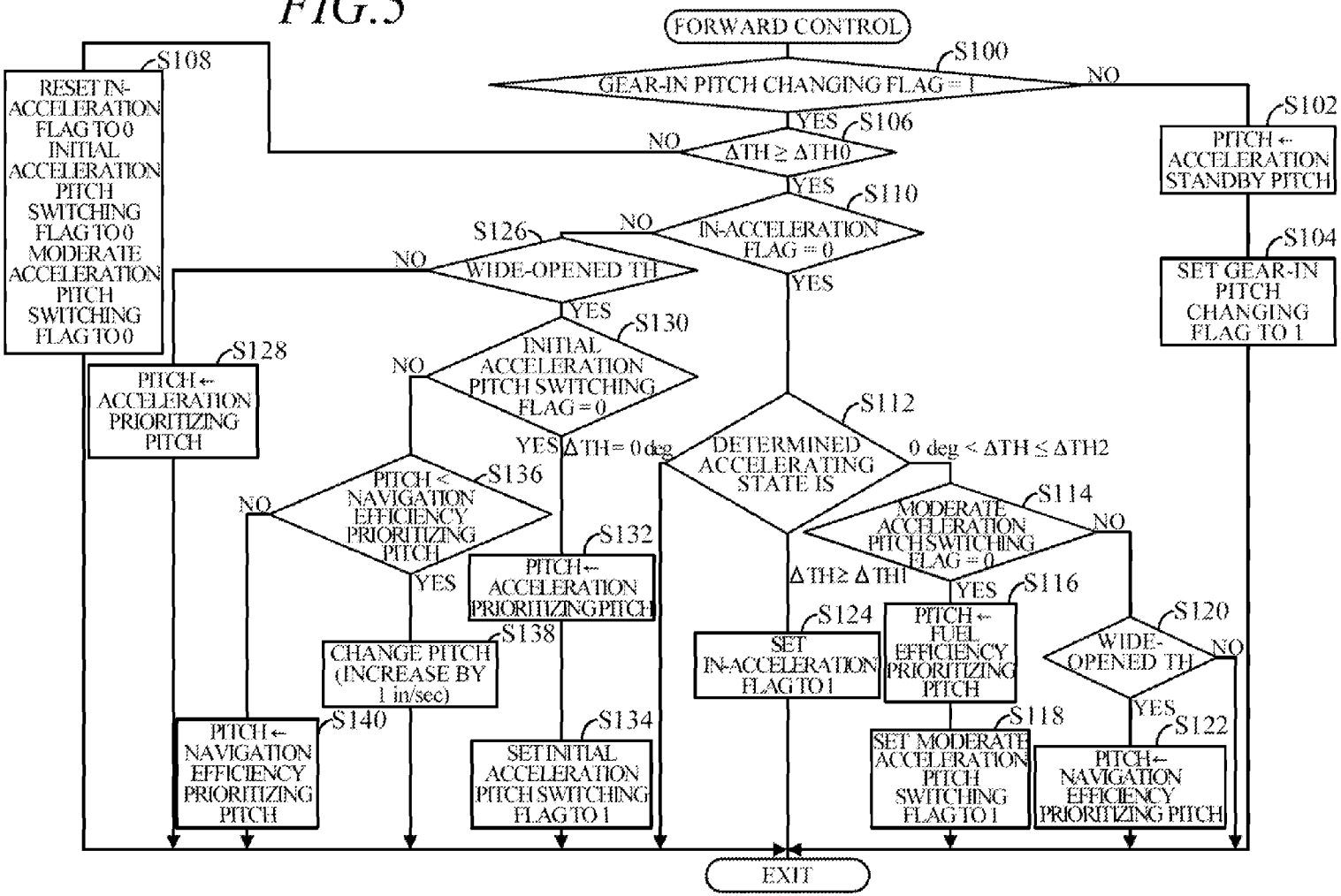
FIG. 5 is a flowchart showing the subroutine of the flowchart of FIG. 4.
Figure 6A:
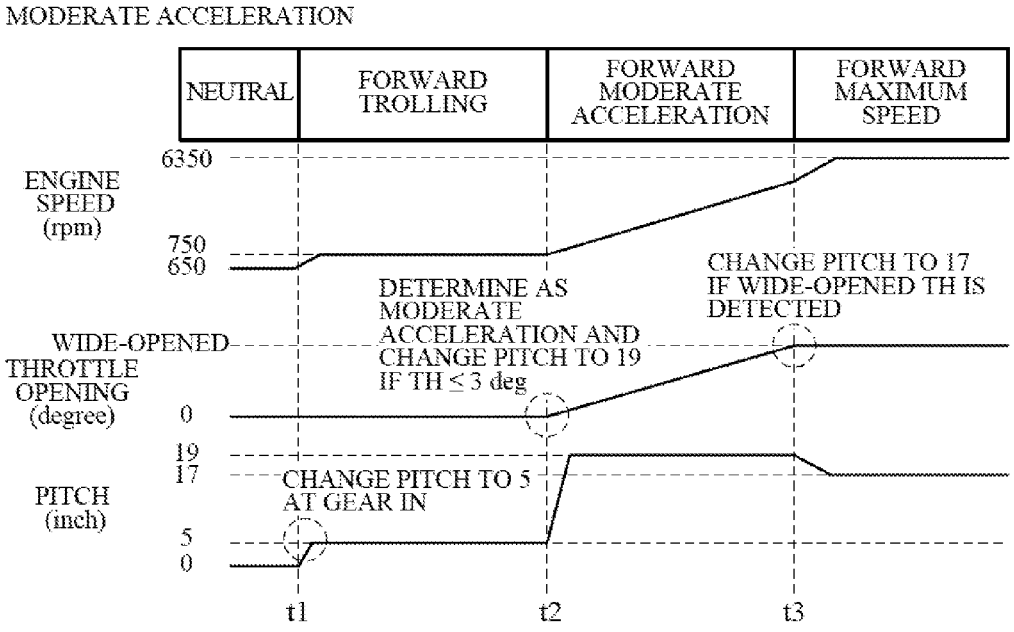
Figure 6B:
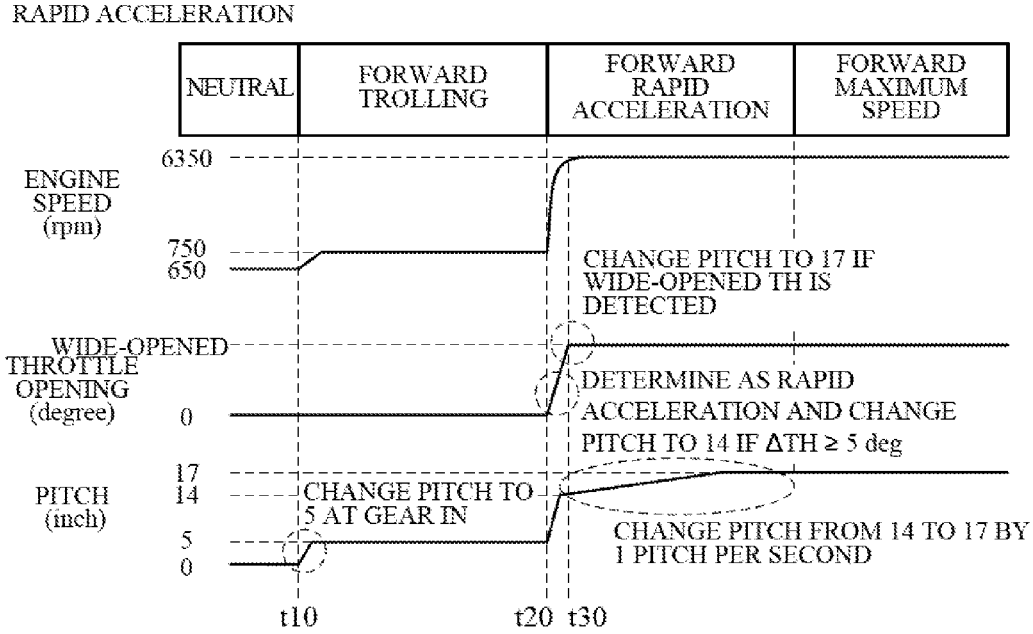

FIGS. 6A-6B is a set of time charts showing operation mentioned in the flowchart of FIG. 5, in which FIG. 6A is a time chart explaining the operation when the boat is under the moderate accelerating state, and FIG. 6B is a time chart explaining the operation when the boat is under the rapid accelerating state.

DESCRIPTION OF EMBODIMENT

A control apparatus for boat according to an embodiment of this invention will be explained with reference to the attached drawings.

Figure 1:
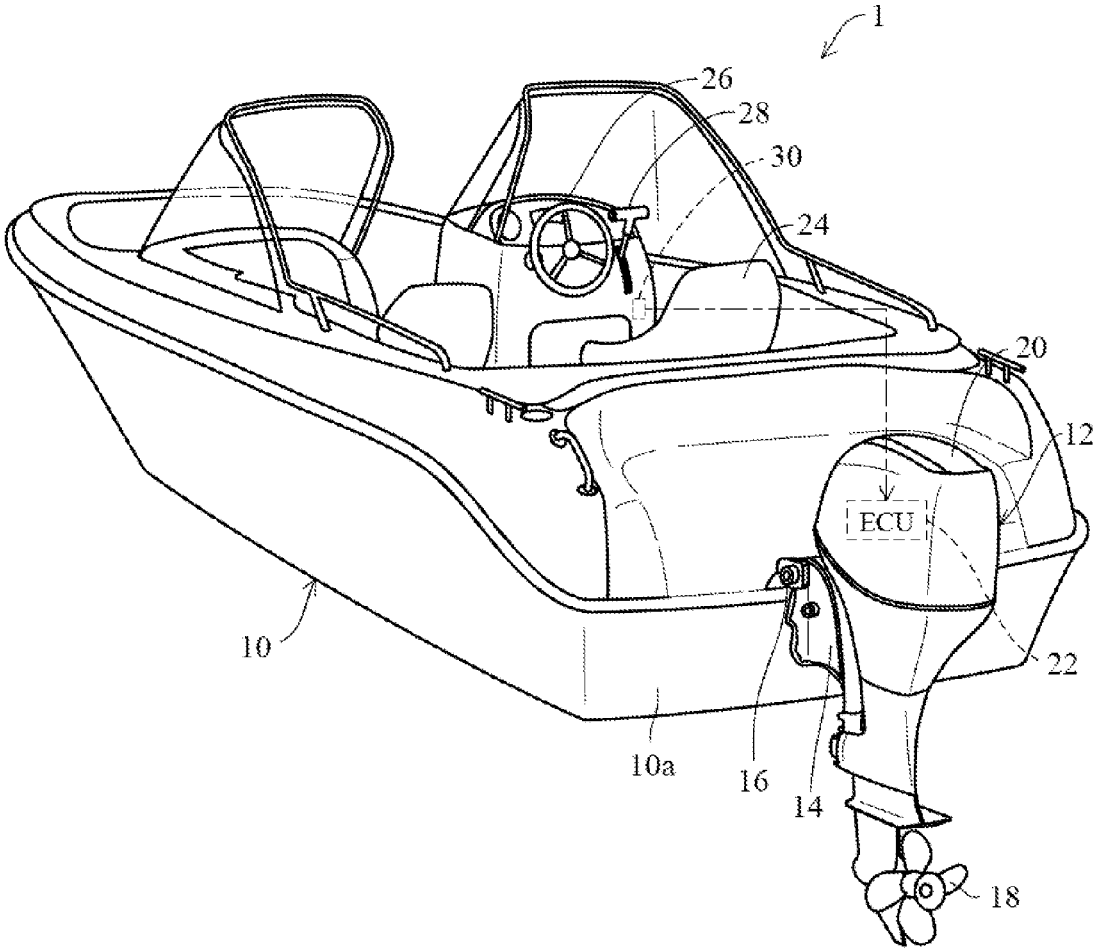
FIG. 1 is an overall schematic view of a control apparatus for boat according to an embodiment of this invention, including a hull.

FIG. 1 is an overall schematic view of a control apparatus for boat according to an embodiment of this invention, including a hull.

In FIG. 1, symbol 1 indicates a boat comprising a hull 10 and an outboard motor 12 mounted on the hull 10. It should be noted that, although this embodiment exemplifies the boat 1 equipped with the outboard motor 12, the boat 1 is not limited to this configuration and can comprise, for example, an inboard-outdrive or inboard motor.

The outboard motor 12 is mounted on a stern or transom 10*a* of the hull 10 with stern brackets 14 and a tilting shaft 16. The outboard motor 12 has an internal combustion engine (not shown in FIG. 1), a propeller 18 connected to and driven by the engine, an engine cover 20 for covering the engine, and an Electronic Control Unit (hereinafter referred to as "ECU") 22 accommodated in an interior space of the engine cover 20 (engine room) to control operations of the outboard motor 12. The ECU 22 has a microcomputer comprising a CPU, ROM, RAM and other devices.

A steering wheel 26 and a shift/throttle lever 28 are installed near a cockpit 24 of the hull 10 to be manipulated by the operator. The shift/throttle lever 28 is adapted to be moved or swung in front-back direction from its initial position and to be used by the operator to input instructions including those on an engine speed, a shift position (forward/reverse) and acceleration/deceleration of the engine.

A shift position sensor 30 is provided near the shift/throttle lever 28 to output a signal SHPS corresponding to a manipulation of the shift/throttle lever 28 by the operator (signal corresponding to a rotation angle of a rotation axis of the shift/throttle lever 28).

Figure 2:
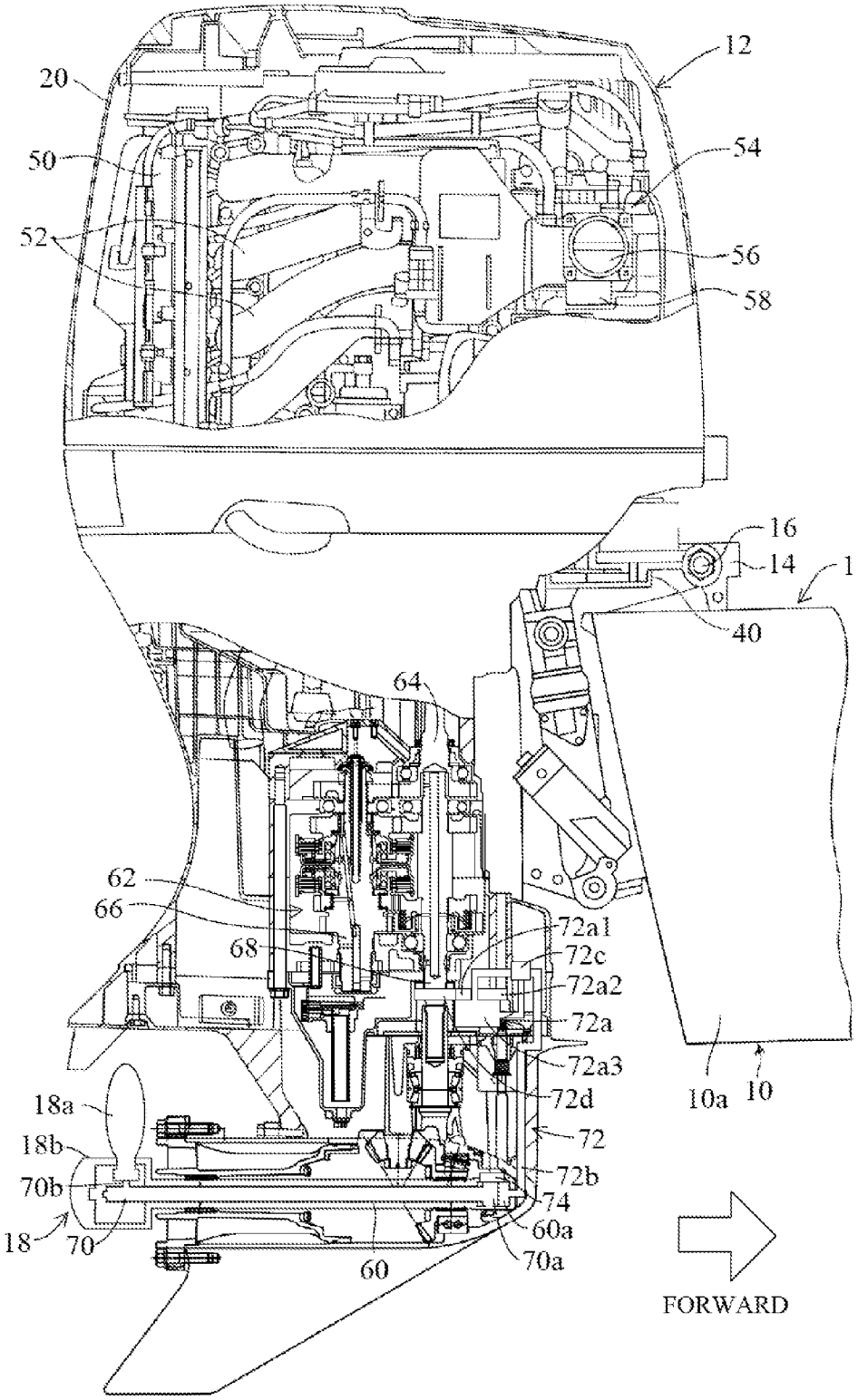
FIG. 2 is an enlarged sectional side view partially showing an outboard motor of the boat shown in FIG. 1.
Figure 3:
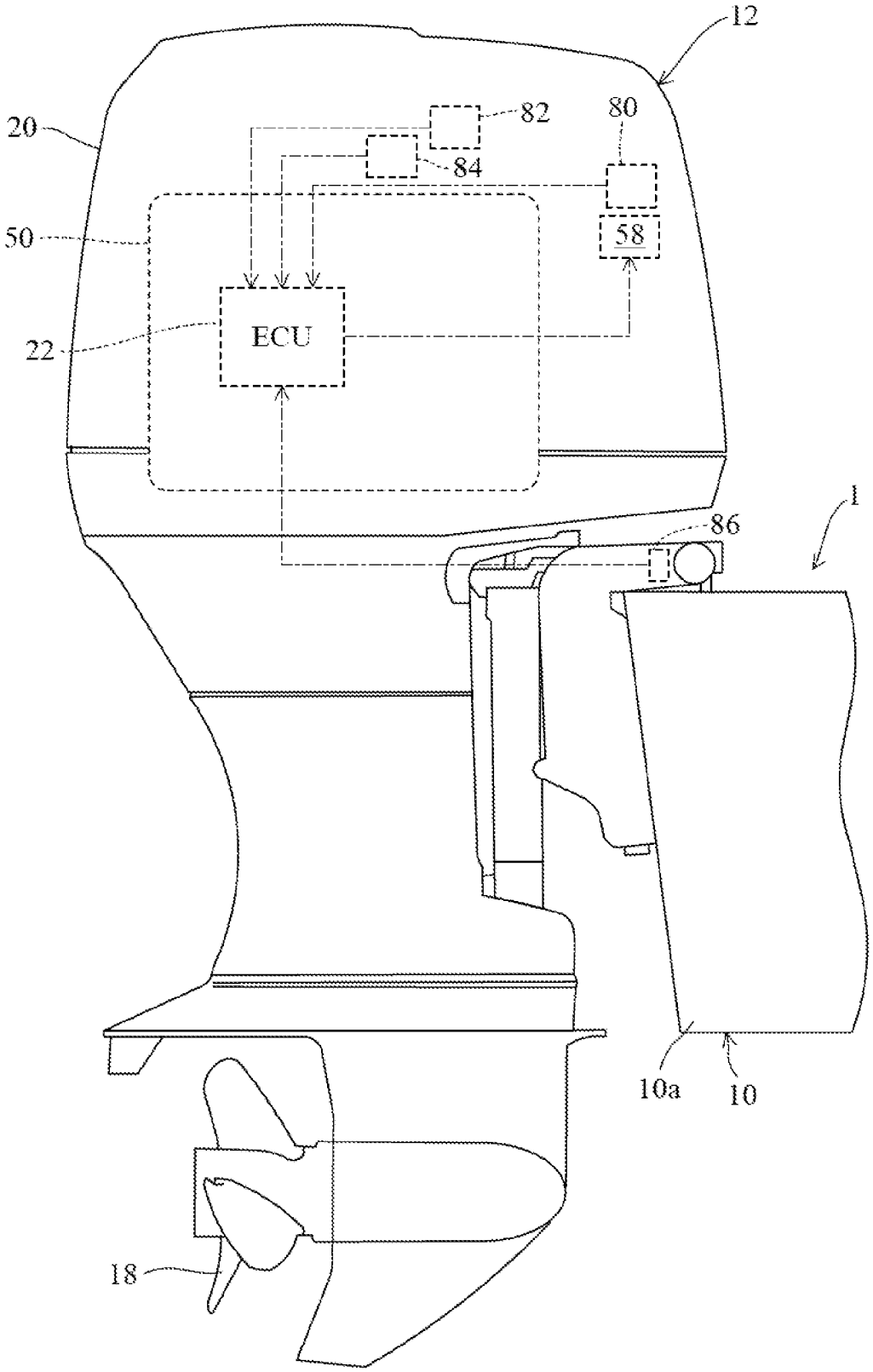
FIG. 3 is an enlarged side view of the outboard motor shown in FIG. 2.

FIG. 2 is an enlarged sectional side view partially showing the outboard motor 12, and FIG. 3 is an enlarged side view of the outboard motor 12.

As shown in FIG. 2, a power tilt/trim unit 42 is installed near a swivel case 40 to regulate a tilt/trim angle to the hull 10 of the outboard motor 12.

The outboard motor 12 is, at its upper portion, provided with the engine (now assigned with symbol 50). The engine 50 comprises a spark-ignition water-cooled gasoline engine with a displacement of 2,200 cc.

A throttle body 54 is connected to an intake pipe 52 of the engine 50. The throttle body 54 has a throttle valve 56 installed therein and is integrated with an electric throttle motor 58 for opening/closing the throttle valve 56.

An output shaft of the electric throttle motor 58 is connected to the throttle valve 56 through a speed reduction gear mechanism (not shown). With this, the throttle valve 56 is opened or closed by operating the electric throttle motor 58 and thereby regulating the flow of intake air to the engine 50 to control the engine speed.

The outboard motor 12 is, at its lower portion, provided with a propeller shaft 60 supported to be rotatable about the horizontal axis and connected to the propeller 18 at one end to transmit the power from the engine 50 to the propeller 18, and a transmission 62 installed between the engine 50 and the propeller shaft 60 and equipped with a plurality of gears including first speed and second speed gears.

The transmission 62 comprises a transmission mechanism that changes (shifts) the gears and a shift mechanism that changes (selects) a shift position from among a forward (FORWARD), reverse (REVERSE) and neutral (NEUTRAL) positions. The transmission mechanism is of a parallel-axis type conventional stepped gear ratio transmission comprising an input shaft 64 connected to a crankshaft (not shown) of the engine 50, a countershaft 66 connected to the input shaft 64 through gears, and an output shaft 68 connected to the countershaft 66 through gears, all disposed in parallel to each other.

The propeller 18 comprises a plurality of blades 18*a* (only one is shown), and a boss 18*b* constituting a body of the propeller 18 and installed with the blades 18*a*. The propeller 18 is a variable pitch propeller and configured to be able to change a pitch angle of the blades 18*a* (angle of the blades 18*a* relative to the forward moving direction of the boat 1).

A pitch of the propeller 18 (distance that the boat 1 advances during one revolution of the propeller 18; ordinarily mentioned in inches) can be changed by changing the pitch angle. The pitch angle is configured to be changeable from plus to minus direction or vice versa steplessly with the pitch angle of 0 degree (i.e., the state that the blade 18*a* stands vertically to the forward moving direction) as a center, in such a manner that the pitch angle can be changed not only in the forward-direction but in the reverse-direction of the boat 1.

The change of the pitch (pitch angle) is made by a blade angle changing shaft (propeller pitch changer) 70 connected to each blade 18*a* of the propeller 18 and a hydraulic mechanism (propeller pitch changer) 72 that controls the operation of the blade angle changing shaft 70.

The blade angle changing shaft 70 comprises a piston rod inserted in a hollow cavity formed in the propeller shaft 60 to be movable in the axial direction, and its one end (right side in the figure) serves as a piston 70*a* and the other end serves as an actuator that extendably/contractably protrudes from an end (left side in the figure) of the propeller shaft 60.

The blade angle changing shaft 70 has a plurality of projections 70*b* (only one is shown) that project in the radial direction from the outer peripheral surface near the tip end (the other side). Specifically, these projections 70*b* are each fitted in a groove formed on a lower portion of blade shaft of each blade 18*a*.

When the projections 70*b* move axially in response to extension/contraction of the blade angle changing shaft 70, the blades 18*a* fitted to the projections 70*b* do not move axially but move (rotate) in the direction that changes the pitch angle in response to the axial motion of the projections 70*b*. Specifically, the axial motion of the projections 70*b* is converted into the change of the pitch angle of the blades 18*a* via the grooves formed on the lower portion of blade shaft.

The blade angle changing shaft 70 is configured such that, for example, when it contracts to a fully contracted position, the pitch angle becomes maximum in the minus direction (reverse-side maximum pitch), when it extends to a center position from the fully contracted position, the pitch angle becomes 0 degree (neutral pitch), and when it extends to a fully extended position from the center position, the pitch angle becomes maximum in the plus direction (forward-side maximum pitch).

As mentioned above, the pitch of the propeller 18, i.e., the pitch angle of the blade 18*a* can be changed by moving (extending/contracting) the blade angle changing shaft 70 in the axial direction.

The hydraulic mechanism 72 comprises a gear pump 72*a*, a pipe 72*b* that connects the gear pump 72*a* and an oil chamber 60*a* formed in the propeller shaft 60, and an electromagnetic solenoid valve 72*c* that regulates amount of hydraulic oil supplied from the gear pump 72*a*, and the like.

The gear pump 72*a* supplies hydraulic oil to the oil chamber 60*a* through the pipe 72*b*, thereby moving the piston 70*a* to the left side in the figure. The gear pump 72*a* is driven by a pump driving gear 72*d* that is fixed to a circumference of the output shaft 68 to be rotated with the output shaft 68.

Since a drive gear 72*a*1 in the gear pump 72*a* is connected to the pump driving gear 72*d*, the drive gear 72*a*1 rotates together with the pump driving gear 72*d*, and a driven gear 72*a*2 meshed with the drive gear 72*a*1 also rotates together. When the drive gear 72*a*1 and the driven gear 72*a*2 are meshed with each other, the gear pump 72*a* sucks hydraulic oil in the gear pump oil chamber 72*a*3 and discharges it from the opposite side.

The pipe 72*b* is equipped with the solenoid valve 72*c* that regulates amount of hydraulic oil supplied from the gear pump 72*a*. The pitch of the propeller 18 can be changed to a predetermined pitch by controlling an opening of the solenoid valve 72*c* to regulate the amount of hydraulic oil supplied from the gear pump 72*a*. A piston position sensor 74 is installed in the oil chamber 60*a* to produce an output or signal indicative of a position of the piston 72*a*. The pitch of the propeller 18 can be detected based on the output from the piston position sensor 74.

As shown in FIG. 3, a throttle opening sensor (throttle opening detector) 80 is installed near the throttle valve 56 to produce an output or signal indicative of a throttle opening TH of the throttle valve 56. A crank angle sensor 82 is installed near the crankshaft of the engine 50. A manifold absolute pressure sensor 84 is installed at an appropriate location of the intake pipe 52 of the engine 50. And, a trim angle sensor 86 is installed near the tilting shaft 16.

Each of these various sensors installed to the outboard motor 12 are communicably connected to the ECU 22 through a communication standard proposed by the NMEA (National Marine Electronics Association; e.g., NMEA2000, i.e., CAN (Controller Area Network)).

The ECU 22 controls operation of the electric throttle motor 58, transmission 62 and propeller pitch changer comprising the blade angle changing shaft 70 and hydraulic mechanism 72.

The control apparatus for the boat 1 according to this embodiment is constituted as a DBW (Drive By Wire) fashion in which the mechanical connection between the operation system (including steering wheel 26 and shift/throttle lever 28) and the outboard motor 12 is cut out.

Figure 4:
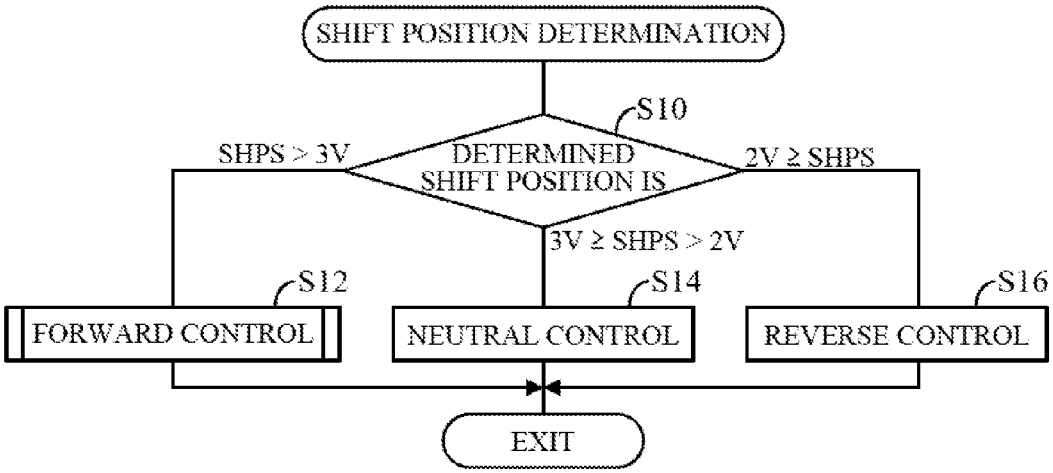
FIG. 4 is a flowchart showing operation of the apparatus shown in FIG. 1.

FIG. 4 is a flowchart showing operation, i.e., a shift position determining operation of the apparatus shown in FIG. 1. The illustrated program is executed by the ECU 22 at a predetermined interval.

The program begins at S10, in which it is determined which shift position is detected based on the output (output voltage) SHPS of the shift position sensor 30. Specifically, it is determined which shift position is detected among FORWARD, NEUTRAL and REVERSE based on the output value SHPS of the shift position sensor 30. In this embodiment, the shift position is determined, for example, to be FORWARD when the output value SHPS of the shift position sensor 30 is greater than 3 V, NEUTRAL when the output value SHPS is equal to or smaller than 3 V, but is greater than 2 V, and REVERSE when the output value SHPS is equal to or smaller than 2 V.

When the output value SHPS of the shift position sensor 30 is determined to be greater than 3 V in S10, since this means that the shift position is FORWARD, the program proceeds to S12, in which a control to change the shift position to forward to advance the boat 1 forward is conducted.

When the output value SHPS of the shift position sensor 30 is determined to be equal to or smaller than 3 V, but is greater than 2 V in S10, since this means that the shift position is NEUTRAL, the program proceeds to S14, in which a control to change the shift position to neutral is conducted.

And, when the output value SHPS of the shift position sensor 30 is determined to be equal to or smaller than 2 V, since this means that the shift position is REVERSE, the program proceeds to S16, in which a control to change the shift position to reverse to advance the boat 1 reverse is conducted.

It should be noted that the neutral control and reverse control will not be explained in detail since these controls have no direct connection with this invention.

FIG. 5 is a flowchart showing the subroutine of the forward control mentioned in S12 of the flowchart of FIG. 4.

The program begins at S100, in which it is determined whether the bit of a gear-in pitch changing flag is 1. The gear-in pitch changing flag is a flag that is set to 1 when the propeller pitch becomes an acceleration standby pitch after the shift position was set to FORWARD and the gear was in-geared (engaged).

The acceleration standby pitch is a propeller pitch that allows the boat 1 to advance at very low speed (acceleration standby state), i.e., the boat 1 advances during one revolution of the propeller 18 is very small (in this embodiment, the acceleration standby pitch is set to 5 inches). Therefore, the pitch angle is predetermined to be slightly inclined relative to 0 degree (neutral pitch of zero thrust).

Since the bit of the gear-in pitch changing flag is initially set to 0, the result in S100 is naturally negative and the program proceeds to S102, in which the propeller pitch is determined to be the acceleration standby pitch, and the program then proceeds to S104, in which the bit of the gear-in pitch changing flag is set to 1.

The result in S100 becomes therefore affirmative in a next program loop and the program proceeds to S106, in which a change amount ΔTH of the throttle valve opening TH per unit time (e.g., 500 milliseconds) is calculated based on the output of the throttle opening sensor 80 and it is determined whether the calculated throttle valve opening change amount per unit time ΔTH is equal to or greater than a prescribed value ΔTH0. The processing in S106 is to determine whether the boat 1 is not under a decelerating state and hence the prescribed value ΔTH0 is set to a negative value (e.g., −0.5 degrees).

When the result in S106 is negative, specifically when it is determined that the change amount per unit time ΔTH is smaller than the prescribed value ΔTH0 and hence the boat 1 is under the decelerating state, the program proceeds to S108, in which the bits of an in-acceleration flag, an initial acceleration pitch switching flag and a moderate acceleration pitch switching flag are reset to 0.

The in-acceleration flag is a flag to indicate whether the boat 1 is under an accelerating state and when this flag is 0, this indicates that the boat 1 is not accelerating. The initial acceleration pitch switching flag and moderate acceleration pitch switching flag will be mentioned below.

On the other hand, when the result in S106 is affirmative, specifically when the boat 1 is determined to be not under the decelerating state, the program proceeds to S110, in which it is determined whether the bit of the in-acceleration flag is 0, i.e., whether the boat 1 is under the accelerating state.

Since the bit of the in-acceleration flag has been set to 0 when the program loops this step for the first time, the result in S110 is naturally negative, and the program proceeds to S112, in which the accelerating state of the boat 1 is determined based on the throttle valve opening change amount per unit time ΔTH.

Specifically, it is determined under which state the boat 1 is from among a non-accelerating state in which the boat 1 is not accelerating (i.e., the throttle valve opening change amount per unit time ΔTH is 0 degree and the shift/throttle lever 28 is not operated), a moderate accelerating state in which the boat 1 is accelerating moderately (i.e., the change amount per unit time ΔTH is greater than 0 degree, but is equal to or smaller than a second predetermined value ΔTH2, and a rapid accelerating state in which the boat 1 is accelerating rapidly (i.e., the change amount per unit time ΔTH is equal to or greater than a first predetermined value ΔTH1.

The value ΔTH2 is a threshold value for determining whether it is under the moderate accelerating state and set to e.g., 3 degrees, and the value ΔTH1 is a threshold value for determining whether it is under the rapid accelerating state and set to e.g., 5 degrees.

When it is determined in S112 that the boat 1 is not accelerating at all, the program is immediately terminated.

On the other hand, when it is determined that the boat 1 is under the moderate accelerating state, the program proceeds to S114, in which it is determined whether the bit of the moderate acceleration pitch switching flag is 0.

The moderate acceleration pitch switching flag is set to 1 when it is determined that the boat 1 is under the moderate accelerating state and the propeller pitch is at a fuel efficiency prioritizing pitch. The fuel efficiency prioritizing pitch (third pitch) is a pitch that prioritizes fuel efficiency, i.e., a pitch that aims for a maximum or almost maximum fuel efficiency at a certain navigation speed and is set to be e.g., 19 inches, through experimentation.

When it is determined that the bit of the moderate acceleration pitch switching flag is 0 and the result in S114 is affirmative, the program proceeds to S116, in which the propeller pitch is determined to be the fuel efficiency prioritizing pitch. Next, the program proceeds to S118, in which the bit of the moderate acceleration pitch switching flag is set to 1, and the program is terminated.

The result in S114 becomes accordingly negative in a next program loop and the program proceeds to S120, in which it is determined whether the throttle valve opening TH is wide-opened (i.e., is fully opened or is nearly fully opened) based on the output value of the throttle opening sensor 80. Here, the determination in S120 will also be applicable in S126 and will be same to determine whether it is equal to or greater than a predetermined throttle valve opening.

When the result in S120 is negative, the program is immediately terminated. On the contrary, when the result in S120 is affirmative, the program proceeds to S122, in which the propeller pitch is determined to be a navigation efficiency prioritizing pitch (second pitch).

The navigation efficiency prioritizing pitch is a pitch that prioritizes a navigation efficiency of the boat 1, specifically a pitch that aims for a maximum navigation speed, more specifically a pitch at which the navigation speed of the boat 1 becomes equal to or greater than a predetermined navigation speed (more precisely at or near the maximum navigation speed) when navigating the boat 1 at an engine speed of maximum power of the engine 50.

In other words, the engine speed that produces the maximum output power varies according to the (type of) engine 50. Therefore, in the embodiment, by determining the maximum power producing engine speed for the engine 50 and by changing the propeller pitch to search a pitch that can advance the boat 1 at a highest navigation speed while operating the engine 50 at the determined maximum power producing engine speed through experimentation, it becomes possible to find out the navigation efficiency prioritizing pitch.

More specifically, if the maximum power producing engine speed of the engine 50 is 6000 rpm, the navigation speed of the boat 1 is measured by navigating the boat 1 at that engine speed and changing the pitch to 10 inches, 11 inches, 12 inches . . . to identify or find out the pitch that produces the maximum navigation speed and determine the propeller pitch to be the navigation efficiency prioritizing pitch. It should be noted that, in this embodiment, the navigation efficiency prioritizing pitch is set to e.g., 17 inches.

When it is determined that the change amount ΔTH is equal to or greater than ΔTH1 and the boat 1 is under the accelerating state in S112, the program proceeds to S124, in which the bit of the in-acceleration flag is set to 1.

The result in S110 becomes accordingly negative in a next program loop and the program proceeds to S126, in which it is determined whether the throttle valve opening TH is wide-opened.

When the result in S126 is negative and the boat 1 is determined to be under the accelerating state (when the bit of the in-acceleration flag is 1), but the throttle valve opening TH is not wide-opened, the program proceeds to S128, in which the propeller pitch is determined to be an acceleration prioritizing pitch. The acceleration prioritizing pitch is a pitch that prioritizes the acceleration performance of the boat 1.

Specifically, it is a pitch at which the acceleration of the boat 1 becomes equal to or greater than a predetermined acceleration (more specifically at or near the maximum acceleration) when navigating the boat 1 at the maximum power producing engine speed and is set as e.g., 14 inches. Assuming that the engine 50 produces the maximum torque at 4500 rpm, the boat 1 is to be navigated at that engine speed and the pitch that produces the maximum acceleration is identified and the propeller pitch is determined to be the acceleration prioritizing pitch.

On the other hand, when the boat 1 is determined to be under the accelerating state, the throttle valve opening TH is wide-opened and the result in S126 is affirmative, the program proceeds to S130, in which it is determined whether the bit of the initial acceleration pitch switching flag is 0.

When the result in S130 is affirmative, the program proceeds to S132, in which the propeller pitch is determined to be the acceleration prioritizing pitch, and then the program proceeds to S134, in which the bit of the initial acceleration pitch switching flag is set to 1 and the program is terminated.

The result in S130 becomes accordingly negative in a next program loop and the program proceeds to S136, in which it is determined whether the propeller pitch is equal to or smaller than the navigation efficiency prioritizing pitch.

When the result in S136 is affirmative, the program proceeds to S138, in which the propeller pitch is increased by a predetermined rate or a predetermined unit amount in such a manner that the pitch angle is changed to increase the pitch by a predetermined amount. Specifically, for example, an increase amount is determined to increase the pitch by 1 inch per second in each program loop. Accordingly when this program loop is executed at intervals of 100 milliseconds, for example, the pitch is increased by 0.1 inches every program loop.

When the pitch is increased to reach the navigation efficiency prioritizing pitch and the result in S136 becomes negative, the program proceeds to S140, in which the pitch is determined to be the navigation efficiency prioritizing pitch.

In the above, when the propeller pitch is determined to be the acceleration standby pitch in S102, or is determined to be the fuel efficiency prioritizing pitch in S116, or is determined to be the navigation efficiency prioritizing pitch in S122 or S14, or is determined to be the acceleration prioritizing pitch in S128 or S132, the ECU 22 operates the propeller pitch changer (blade angle changing shaft 70 and hydraulic mechanism 72) to change the pitch to the determined one if the current pitch is different therefrom.

Having been configured in the foregoing manner in the embodiment, when the boat 1 is determined to be accelerating (S110) but the throttle valve 56 is not wide-opened (S126), the pitch is changed to the acceleration prioritizing pitch (S128). Then, when the throttle valve opening TH becomes wide-opened, the pitch is changed to the navigation efficiency prioritizing pitch (S140).

However, the pitch is not changed to the navigation efficiency prioritizing pitch immediately, but is changed (increased) stepwise by the predetermined rate (S136, S138), in order to improve the acceleration efficiency up to the maximum navigation speed by increasing the engine speed smoothly from that for producing the maximum engine torque to that for producing the maximum engine output power.

FIGS. 6A-6B is a set of time charts partially showing operation mentioned in the flowchart of FIG. 5, in which FIG. 6A is a time chart explaining the operation when the boat 1 is under the moderate accelerating state, and FIG. 6B is a time chart explaining the operation when the boat 1 is under the rapid accelerating state.

Explaining the operation when the boat 1 is under the moderate accelerating state first with reference to FIG. 6A, when the gear position is shifted from neutral to forward and geared in at time t1, the propeller pitch is changed from 0 to 5 inches of the acceleration standby pitch and the trolling operation is conducted by the acceleration standby pitch until time t2.

Then, when the throttle valve opening change amount ΔTH becomes a positive value (specifically 3 degrees or less for the moderate accelerating state), the pitch is increased to 19 inches for the fuel efficiency prioritizing pitch, rendering the boat 1 to the fuel efficiency prioritizing operational state.

When the throttle valve opening TH becomes wide-opened at time t3, the propeller pitch is decreased or changed to 17 inches of the navigation efficiency prioritizing pitch.

Thus, the fuel efficiency prioritizing operation is conducted when the boat 1 is moderately accelerating and the propeller pitch is changed to the operation that aims for the maximum navigation speed when the throttle valve opening becomes wide-opened.

Specifically, when the boat 1 is under the moderate accelerating state (S112), the propeller pitch is set to the fuel efficiency prioritizing pitch first and the fuel efficiency prioritizing operation is conducted (S116), and when the throttle valve opening TH becomes wide-opened (S120), the propeller pitch is then changed to the navigation efficiency prioritizing pitch to switch to the navigation speed prioritizing operation (S122).

Next, the operation when the boat 1 is under the rapid accelerating state will be explained with reference to FIG. 6B.

When the gear position is shifted from neutral to forward and geared in at time t10, the propeller pitch is changed from 0 to 5 inches of the acceleration standby pitch in the same manner as the moderate accelerating state and kept to 5 inches until time t20.

When the throttle valve opening change amount ΔTH becomes equal to or greater than 5 degrees and the boat 1 comes into the rapid accelerating state at time t3, the pitch is increased to 14 inches of the acceleration prioritizing pitch, rendering the boat 1 to accelerate more smoothly.

Alternatively, when the throttle valve opening TH becomes wide-opened at time t3, the pitch is increased to 17 inches of the navigation efficiency prioritizing pitch as is the case of the moderate accelerating state. If the pitch is increased from 14 inches of the acceleration prioritizing pitch to 17 inches of the navigation efficiency prioritizing pitch, the pitch is increased by inches, for example, by 1 inch per second as mentioned above.

In this way, the acceleration prioritizing operation is conducted when the boat 1 is under the rapid accelerating state and when the throttle valve opening becomes wide-opened, the propeller pitch is controlled in such a manner that the maximum navigation speed can be achieved smoothly.

Specifically, when the boat 1 is determined to be accelerating (S110) and the throttle valve opening TH is not wide-opened (S126), the propeller pitch is determined to be the acceleration prioritizing pitch to conduct the acceleration prioritizing operation (S128).

Here, explaining determination of the fuel efficiency prioritizing pitch once again, the navigation efficiency prioritizing pitch should first be determined and then the pitch should be changed from the navigation efficiency prioritizing pitch by inches to find out the fuel efficient prioritizing pitch.

In the embodiment, the fuel efficiency prioritizing pitch is set to be greater than the navigation efficiency prioritizing pitch by a prescribed amount (2 inches). The reason is that, since it is confirmed from experiments that the fuel efficiency becomes highest when the pitch is increased by 2 inches from the fuel efficiency prioritizing pitch. Having learned from the experiments, the fuel efficiency prioritizing pitch will be sufficient if it is set to be higher than the navigation efficiency prioritizing pitch by about 5% to 15%, more preferably about 10%. However, since the percentages will be different for different propellers, they may differ to some extent.

As stated above, the embodiment of this invention is configured to have an apparatus or method for controlling a boat (1) equipped with an outboard motor (12) mounted on its stern (10*a*) and having an internal combustion engine (50), a propeller (18) to be driven by the engine and a propeller pitch changer (blade angle changing shaft 70, hydraulic mechanism 72) adapted to variably change a pitch of the propeller, comprising: a throttle opening detector (throttle opening sensor 80, ECU 22) that detects an opening of a throttle valve (56) installed at an air intake system of the engine; a throttle opening change amount calculator (ECU 22) that calculates a change amount of the detected opening of the throttle valve; and a propeller pitch change determiner (ECU 22, S102, S116, S122, S128, S132, S140) that determines whether or not the pitch of the propeller is to be changed through the propeller pitch changer based on the change amount of the detected opening of the throttle valve. With this, it becomes possible to select the optimum pitch according to the navigation state of the boat 1 to enhance all of the fuel efficiency, acceleration performance and maximum-speed performance.

In the apparatus and method, if the calculated throttle valve opening change amount is equal to or greater than a first predetermined value (ΔTH1) and the detected throttle valve opening is smaller than a prescribed value (wide-opened throttle opening), the propeller pitch change determiner determines that the pitch of the propeller is to be changed to a first pitch (acceleration prioritizing pitch) at which acceleration of the boat becomes equal to or greater than a predetermined value when the boat is navigated at an engine speed that produces a maximum torque (ECU 22, S110, S112, S124, S126, S128). With this, it becomes possible to enhance acceleration performance. In addition, it becomes possible to suppress cavitation that could occur at rapid acceleration.

In the apparatus and method, if the calculated throttle valve opening change amount is smaller than the first predetermined value and the detected throttle valve opening is equal to or greater than the prescribed value, the propeller pitch change determiner determines that the pitch of the propeller is to be changed to a second pitch (navigation efficiency prioritizing pitch) at which navigation speed of the boat 1 becomes equal to or greater than a predetermined speed when the engine is operated at a speed that produces a maxim output power (ECU 22, S120, S122, S126, S130, S136, S140). With this, it becomes possible to easily attain the maximum navigation speed, when the throttle valve opening TH is equal to or greater than the predetermined throttle valve opening.

In the apparatus and method, if the calculated throttle valve opening change amount is equal to or smaller than a second predetermined value (ΔTH2) set to be smaller than the first predetermined value, the propeller pitch change determiner determines that the pitch of the propeller is to be changed to a third pitch (fuel efficiency prioritizing pitch) set to be greater than the second pitch (ECU 22, S112, S114, S116). With this, it becomes possible to enhance fuel efficiency when the throttle valve opening change amount ΔTH is equal to or smaller than the second predetermined value.

In the apparatus and method, when the propeller pitch change determiner determines that the pitch of the propeller is to be changed from the first pitch to the second pitch, it determines that the pitch of the propeller is to be changed from the first pitch to the second pitch stepwise by a unit amount (ECU 22, S136, S138, S140). With this, it becomes possible to enhance the acceleration efficiency up to the maximum navigation speed.

It should be noted that, in the embodiment, although the pitch angle of the propeller 18 is changed by the propeller pitch changer comprising the blade angle changing shaft 70 and hydraulic mechanism 72, changing of the pitch angle should not be limited thereto.

It should further be noted that, in the embodiment, although the throttle valve opening change amount ΔTH0, ΔTH1, ΔTH2, and the pitch including the acceleration standby pitch, fuel efficiency prioritizing pitch, navigation efficiency prioritizing pitch, acceleration prioritizing pitch etc. are mentioned above as specific values, they are merely examples and should not be limited thereto.

Japanese Patent Application No. 2013-127113, filed on Jun. 18, 2013, is incorporated by reference herein in its entirety.

While the invention has thus been shown and described with reference to a specific embodiment, it should be noted that the invention is in no way limited to the details of the described arrangement; changes and modifications may be made without departing from the scope of the appended claims.

What is claimed is:

1. An apparatus for controlling a boat equipped with an outboard motor mounted on its stern and having an internal combustion engine, a propeller to be driven by the engine and a propeller pitch changer adapted to variably change a pitch of the propeller, comprising:

a throttle opening detector that detects an opening of a throttle valve installed at an air intake system of the engine;

a throttle opening change amount calculator that calculates a change amount of the detected opening of the throttle valve; and a propeller pitch change determiner that determines whether or not the pitch of the propeller is to be changed through the propeller pitch changer based on the calculated change amount of the opening of the throttle valve, wherein:

if the calculated change amount is equal to or greater than a first predetermined value and the detected opening is smaller than a prescribed value, the propeller pitch change determiner determines that the pitch of the propeller is to be changed to a first pitch, at which an acceleration of the boat becomes equal to or greater than a predetermined value when the boat is navigated at an engine speed that produces a maximum torque, and if the detected opening is equal to or greater than the prescribed value, the propeller pitch change determiner determines that the pitch of the propeller is to be changed to a second pitch, at which a navigation speed of the boat becomes equal to or greater than a predetermined speed when the engine is operated at a speed that produces a maximum output power.

2. The apparatus according to claim 1, wherein the first pitch is a pitch at which the acceleration of the boat becomes a maximum acceleration when the boat is navigated at the engine speed that produces the maximum torque, and the second pitch is a pitch at which the navigation speed of the boat becomes a maximum navigation speed when the engine is operated at the speed that produces the maximum output power.

3. The apparatus according to claim 1, wherein if the calculated change amount is equal to or smaller than a second predetermined value set to be smaller than the first predetermined value, the propeller pitch change determiner determines that the pitch of the propeller is to be changed to a third pitch set to be greater than the second pitch.

4. The apparatus according to claim 1, wherein when the propeller pitch change determiner determines that the pitch of the propeller is to be changed from the first pitch to the second pitch, it determines that the pitch of the propeller is to be changed from the first pitch to the second pitch stepwise by a unit amount.

5. An apparatus for controlling a boat equipped with an outboard motor mounted on its stern and having an internal combustion engine, a propeller to be driven by the engine and a propeller pitch changer adapted to variably change a pitch of the propeller, comprising:

a throttle opening detecting means for detecting an opening of a throttle valve installed at an air intake system of the engine;

a throttle opening change amount calculating means for calculating a change amount of the detected opening of the throttle valve; and a propeller pitch change determining means for determining whether or not the pitch of the propeller is to be changed through the propeller pitch changer based on the calculated change amount of the opening of the throttle valve, wherein if the calculated change amount is equal to or greater than a first predetermined value and the detected opening is smaller than a prescribed value, the propeller pitch change determining means determines that the pitch of the propeller is to be changed to a first pitch, at which an acceleration of the boat becomes equal to or greater than a predetermined value when the boat is navigated at an engine speed that produces a maximum torque, and if the detected opening is equal to or greater than the prescribed value, the propeller pitch change determining means determines that the pitch of the propeller is to be changed to a second pitch, at which a navigation speed of the boat becomes equal to or greater than a predetermined speed when the engine is operated at a speed that produces a maximum output power.

6. The apparatus according to claim 5, wherein the first pitch is a pitch at which the acceleration of the boat becomes a maximum acceleration when the boat is navigated at the engine speed that produces the maximum torque, and the second pitch is a pitch at which the navigation speed of the boat becomes a maximum navigation speed when the engine is operated at the speed that produces the maximum output power.

7. The apparatus according to claim 5, wherein if the calculated change amount is equal to or smaller than a second predetermined value set to be smaller than the first predetermined value, the propeller pitch change determining means determines that the pitch of the propeller is to be changed to a third pitch set to be greater than the second pitch.

8. The apparatus according to claim 5, wherein when the propeller pitch change determining determines that the pitch of the propeller is to be changed from the first pitch to the second pitch, it determines that the pitch of the propeller is to be changed from the first pitch to the second pitch stepwise by a unit amount.

9. A method for controlling a boat equipped with an outboard motor mounted on its stern and having an internal combustion engine, a propeller to be driven by the engine and a propeller pitch changer adapted to variably change a pitch of the propeller, comprising the step of:

detecting an opening of a throttle valve installed at an air intake system of the engine;

calculating a change amount of the opening of the throttle valve; and determining whether or not the pitch of the propeller is to be changed through the propeller pitch changer based on the calculated change amount of the opening of the throttle valve, wherein if the calculated change amount is equal to or greater than a first predetermined value and the detected opening is smaller than a prescribed value, the step of propeller pitch change determining determines that the pitch of the propeller is to be changed to a first pitch, at which an acceleration of the boat becomes equal to or greater than a predetermined value when the boat is navigated at an engine speed that produces a maximum torque, and if the detected opening is equal to or greater than the prescribed value, the step of propeller pitch change determining determines that the pitch of the propeller is to be changed to a second pitch, at which a navigation speed of the boat becomes equal to or greater than a predetermined speed when the engine is operated at a speed that produces a maximum output power.

10. The method according to claim 9, wherein the first pitch is a pitch at which the acceleration of the boat becomes a maximum acceleration when the boat is navigated at the engine speed that produces the maximum torque, and the second pitch is a pitch at which the navigation speed of the boat becomes a maximum navigation speed when the engine is operated at the speed that produces the maximum output power.

11. The method according to claim 9, wherein if the calculated change amount is equal to or smaller than a second predetermined value set to be smaller than the first predetermined value, the step of propeller pitch change determining determines that the pitch of the propeller is to be changed to a third pitch set to be greater than the second pitch.

12. The method according to claim 9, wherein when the step of propeller pitch change determining determines that the pitch of the propeller is to be changed from the first pitch to the second pitch, it determines that the pitch of the propeller is to be changed from the first pitch to the second pitch stepwise by a unit amount.

* * * * *